US005251591A

United States Patent [19]

Corrin

[11] Patent Number: 5,251,591

[45] Date of Patent: Oct. 12, 1993

[54] ROTARY VALVE FOR AN INTERNAL COMBUSTION ENGINE

[76] Inventor: William R. Corrin, 4327 E. Colorado St., Long Beach, Calif. 90814

[21] Appl. No.: 927,744

[22] Filed: Aug. 10, 1992

[51] Int. Cl.[5] ..... F01L 7/00; F02D 9/08

[52] U.S. Cl. ..... 123/190.6; 123/190.8; 123/337

[58] Field of Search ..... 123/190.1, 190.12, 190.4, 123/190.5, 190.6, 190.8, 190.2, 336, 337

[56] References Cited

U.S. PATENT DOCUMENTS

| | | | |
|---|---|---|---|
| 1,018,386 | 2/1912 | Ballou | 123/190 |
| 1,059,516 | 4/1913 | Baverey | 123/190 |
| 1,102,183 | 6/1914 | Augustin et al. | 123/190 |
| 1,115,987 | 11/1914 | Taft | 123/190.1 |
| 1,130,872 | 3/1915 | Winckler | 123/190 |
| 1,299,264 | 4/1919 | Thayer | 123/190 |
| 1,347,919 | 7/1920 | Stokes | 123/190 |
| 1,378,092 | 5/1921 | Carmody | 123/190 |
| 1,403,721 | 1/1922 | Thiede | 123/190 |
| 1,539,975 | 6/1925 | Triefenbach et al. | 123/190 |
| 1,693,484 | 11/1928 | Johnson | 123/190 |
| 1,751,080 | 3/1930 | Fry | 123/190 |
| 1,871,502 | 8/1932 | De Loach | 123/190 |
| 1,924,188 | 8/1933 | Hall | 123/190 |
| 1,971,060 | 8/1934 | Wills | 123/190 |
| 2,116,022 | 5/1938 | Gross | 123/190 |
| 2,155,143 | 4/1939 | McDermett | 123/190 |
| 2,156,960 | 5/1939 | Baer | 123/190.1 |
| 2,975,774 | 3/1961 | Coffey et al. | 123/190 |
| 3,060,915 | 10/1962 | Cole | 123/190 |
| 3,405,701 | 10/1968 | Mealin et al. | 123/190.4 |
| 3,990,423 | 11/1976 | Cross et al. | 123/190 |
| 4,036,184 | 7/1977 | Guenther | 123/190.2 |
| 4,064,857 | 12/1977 | Williams | 123/337 |
| 4,094,289 | 6/1978 | Wessel | 123/337 |
| 4,342,294 | 8/1982 | Hopkins | 123/190 |
| 4,363,302 | 12/1982 | Pischinger | 123/337 |
| 4,751,900 | 6/1988 | Ruffolo | 123/190.8 |

FOREIGN PATENT DOCUMENTS

| | | | |
|---|---|---|---|
| 0267843 | 12/1913 | Fed. Rep. of Germany | 123/190.8 |
| 0795973 | 5/1936 | France | 123/190.8 |
| 0202338 | 11/1983 | Japan | 123/336 |
| 2223800 | 4/1990 | United Kingdom | 123/190.1 |

*Primary Examiner*—E. Rollins Cross
*Assistant Examiner*—Erick Solis
*Attorney, Agent, or Firm*—James M. Skorich

[57] ABSTRACT

A valve is comprised of two parallel passageways running transversely through a cylindrical valve shaft. Several valves are spaced axially in the valve shaft. The valve shaft axially rotates in the upper portion of an internal combustion engine. Each of the valves is positioned adjacent an engine cylinder. Rotation of the valve shaft causes the passageways to allow fluid communication between an engine cylinder and, alternatively, intake and exhaust ports, thereby performing the valving function for that engine cylinder. Two parallel valve shafts are used so that each cylinder is serviced by two valves. The parallel valve shafts and the engine crankshaft are connected to a timing chain assembly which coordinates the rotation of the valves with the translational motion of the engine pistons. A retractable throttle valve is located in the intake port for each valve and controls the amount of the fuel and air mixture flowing through the valve and into the engine cylinder being serviced by that valve. The two throttle valves for each engine cylinder retract in opposite directions.

15 Claims, 6 Drawing Sheets

FIG. 4.
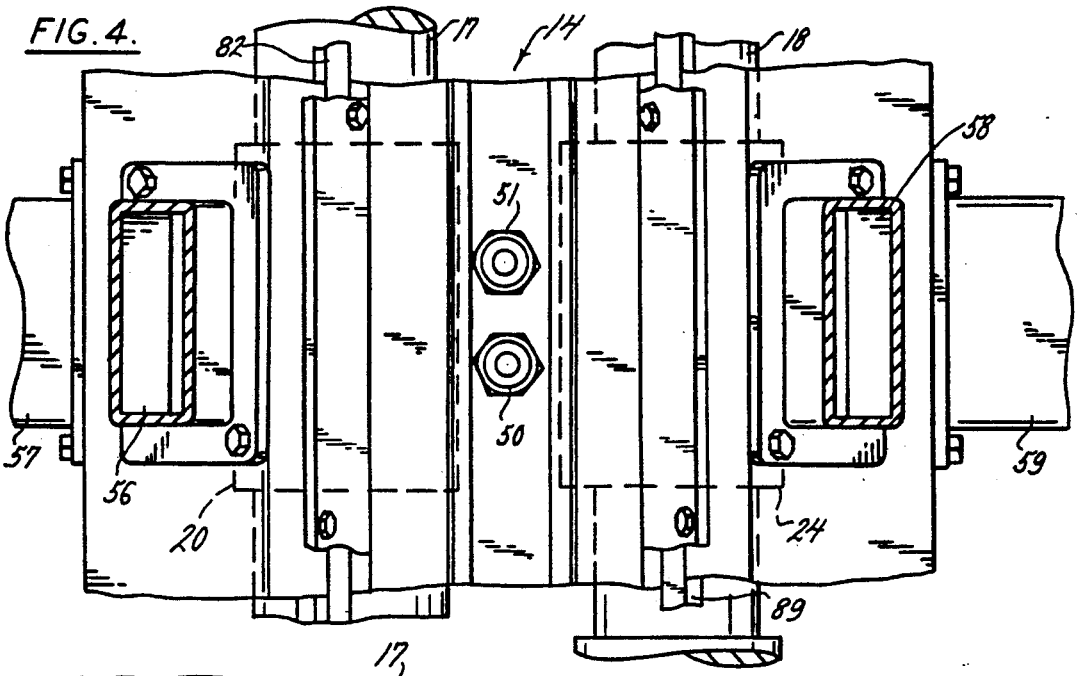
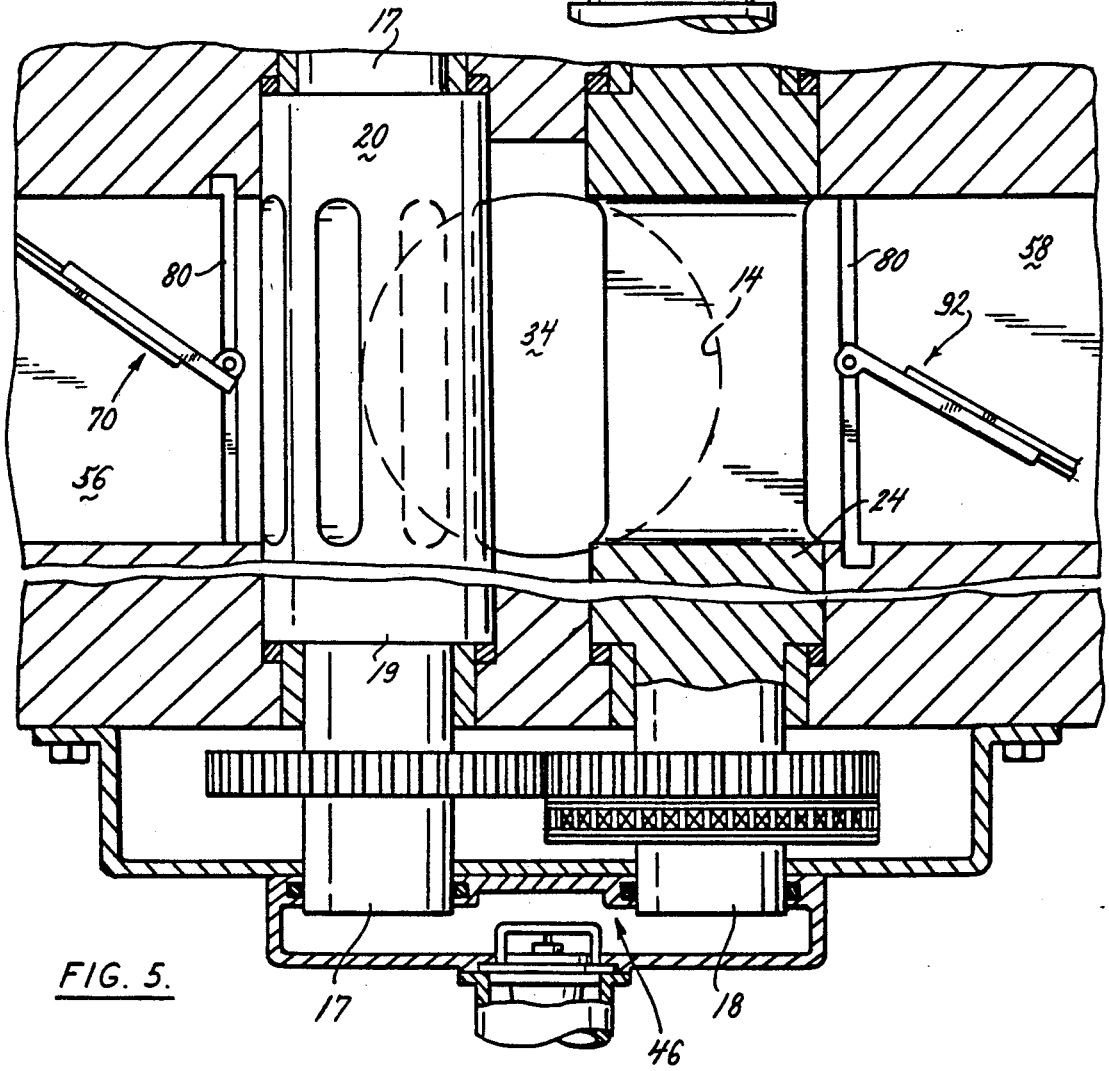
FIG. 5.

FIG. 8.
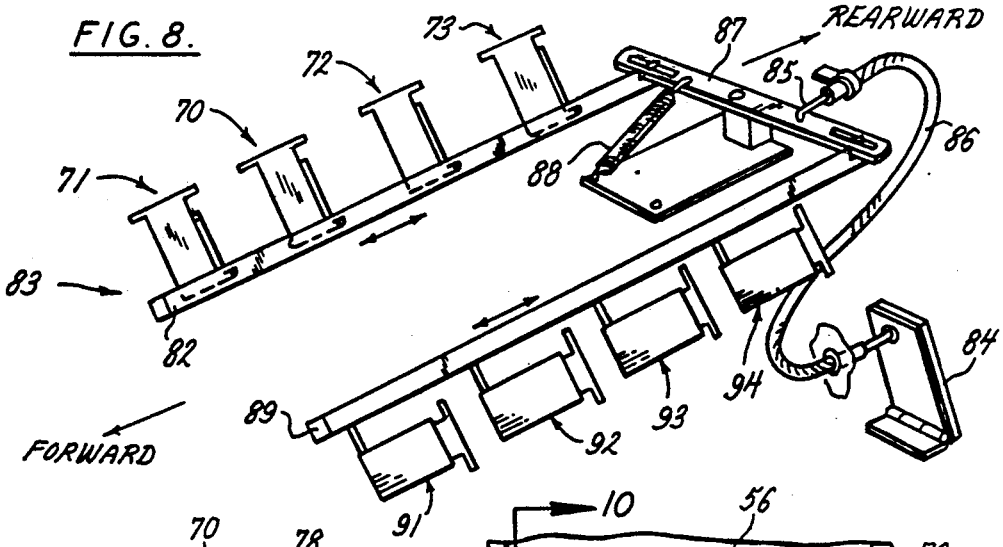
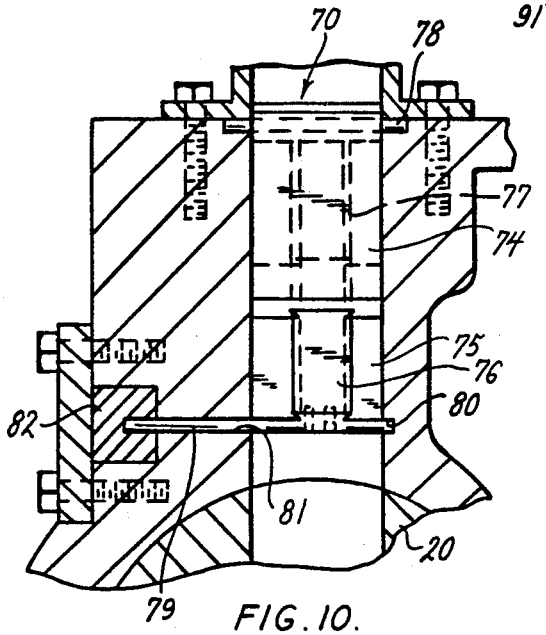
FIG. 10.
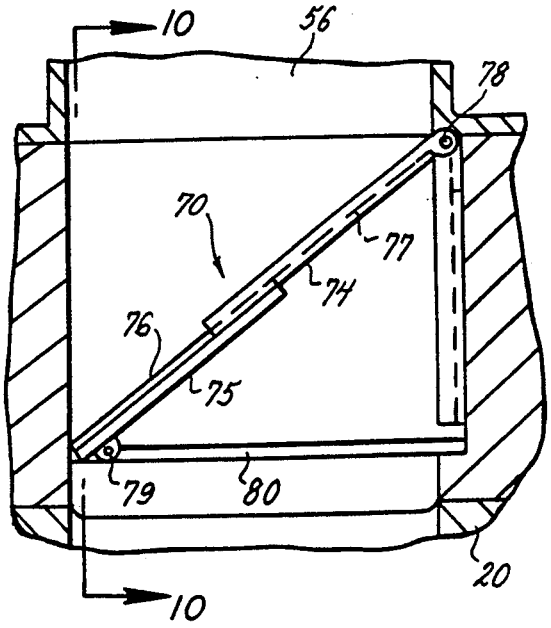
FIG. 9.
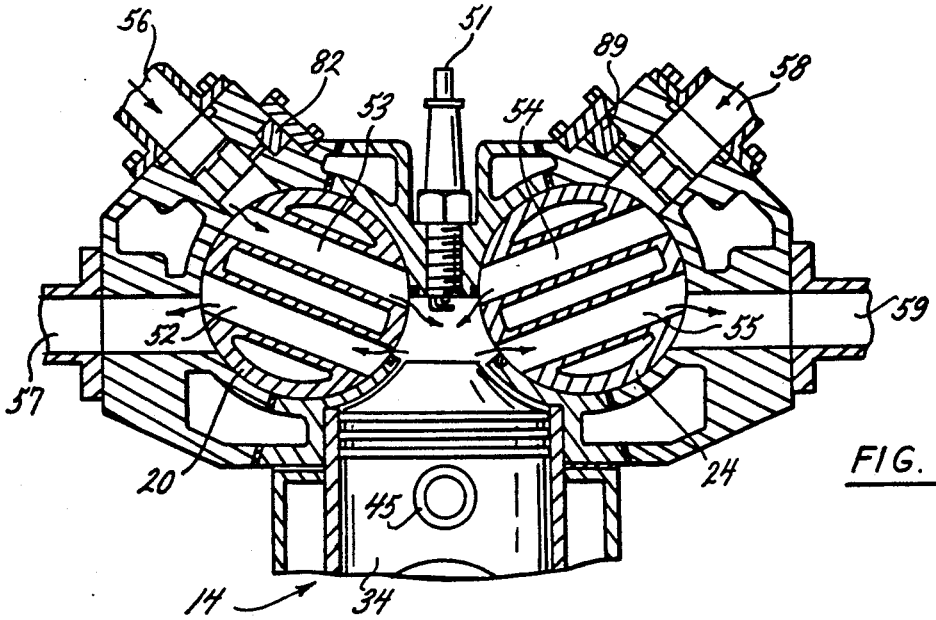
FIG. 11.

ROTARY VALVE FOR AN INTERNAL COMBUSTION ENGINE

BACKGROUND OF THE SPECIFICATION

1. Field of the Invention

The present invention relates to a valve for an internal combustion engine and, more particularly, to a cylindrical rotary valve having two transverse parallel passageways.

2. Description of Related Art

Inherent to the operation of a reciprocating internal combustion engine is the requirement that it have a valve or valves for reliably communicating a mixture of fuel and air into the engine cylinders and for subsequently exhausting the products of combustion. A concomitant requirement is that such valves open and close during the appropriate periods in the operation cycle. The valves must also provide for a tight seal when they are in a closed position.

The common approach to the valve requirements of the reciprocating internal combustion engine is the use of one or more spring-loaded tulip-shaped valve structures formed from metal. Each valve head seats tightly into a tapered opening, or port, in the head wall of the engine cylinder to seal the cylinder. This requires that the valve head have a very precise shape, with low tolerance for deviation from the design specification.

The valve includes an elongated stem which moves reciprocally in a guide, which is comprised of a bore in the cylinder head. A spring fits around the valve stem and is attached to the top of the stem. The spring is in compression and exerts an axial force which, in the absence of an opposing axial force on the end of the valve stem, is sufficient to keep the valve seated.

The end of the valve stem abuts one end of a pivoting rocker arm. The other end of the rocker arm abuts the end of a push rod. The push rod is reciprocally moved axially by a solid lifter which rides on a cam lobe on a camshaft. The camshaft is rotated by the engine crankshaft by means of a reduction gear or a gear and chain arrangement. Rotation of the crankshaft is thereby mechanically translated into an axial force on the valve stem which opposes the spring force. The force translated through a push rod when the lifter is riding on the high point of a lobe on the camshaft is sufficient to overcome the spring force and unseat the valve by pushing it into the cylinder.

This type of intake and exhaust valve has been widely adopted as the solution for the valving requirements of the internal combustion engine primarily because of the relative ease by which adjustments can be made for wear, reasonable manufacturing costs, and the proven reliability of the design. However, as hereinafter detailed, the intrinsic disadvantages of such valves and the necessary compromises in engine performance occasioned by their use are numerous.

The mechanical linkage which connects the valve to the crankshaft is noisy and subject to wear due to friction between the numerous moving parts. The wear decreases key part dimensions and thereby causes the valve to open later and close earlier than the design specifications, a conditions known as "valve lag." This decreases the period the valve remains open, deleteriously affecting engine efficiency and performance.

Furthermore, the harsh operational environment of the valve and the assorted mechanical parts necessary to drive it through its reciprocating motion requires that they be formed from durable metal that retains its strength at high temperatures, and thus has a high density which results in each of the parts having a relatively high mass. As the valve and its associated parts are in motion during every combustion cycle, their high masses give rise to inertial forces which can cause the movement of the valve to lag behind its design parameters, especially at high rates of crankshaft revolution.

In addition, at very high rates of crankshaft revolution the valve spring force is ofttimes not sufficient to completely seat the valve head before the beginning of the subsequent engine cycle, a condition known as "valve float." In such a situation, damage to the valve, cylinder wall or piston can result from the piston striking the unseated or "floating" valve head. This problem can be overcome to some extent by increasing the spring force, but this remedy adds greatly to the wear on the valve actuating mechanism and may also cause bending or fracture of the push rod.

The noise of the conventional intake and exhaust valve and the wear and concomitant adjustment requirements can be reduced by replacing the solid lifters with hydraulic lifters. However, such a modification aggravates the problem of valve float.

Another approach to the long-standing problem of valve lag is to locate the camshaft above or adjacent to the intake and exhaust valves and place the end of the valve stem in direct contact with the camshaft lobe or rocker arm. This eliminates the need for a lifter, a push rod, and possibly a rocker arm, and thus reduces the mass and the inertia of the valve mechanism. However, although improving the performance of the valve at high rates of crankshaft revolution, the increased distance between the camshaft and the crankshaft relative the the conventional camshaft location requires a more complex mechanism to maintain the necessary revolution ratio between the camshaft and the crankshaft. This increase in complexity increases the cost of the valve mechanism.

As the conventional valve is seated in a port in the head wall of the cylinder, its diameter is limited by the diameter of the bore of the cylinder. The valve diameter, in turn, limits the flow rate of the mixture of air and fuel that can be drawn into the cylinder, as well as the flow rate of combustion products exhausted out of the cylinder. The more of the combustible mixture that can be drawn into the cylinder during the charging interval of the combustion cycle, the more power the engine can produce during the combustion cycle. The quotient of power divided by the volume of the cylinders is known as the volumetric efficiency of the engine.

The valve diameter also directly affects the work required of the reciprocating piston to draw the combustible mixture into the cylinder and exhaust the products of combustion from the cylinder, a parasitic power loss known as the "pumping loss." The larger the valve diameter, the lower the "pumping loss."

Use of the conventional intake and exhaust valve has obliged engineers to increase bore diameter of the cylinder in order to increase the valve diameter and realize the attendant power gains, albeit ofttimes at the sacrifice of other performance parameters. Another means of increasing volumetric efficiency is to increase the number of valves, while making them smaller in diameter. Although this approach will improve volumetric efficiency, the increased complexity and miniaturization of the valve mechanism increases its cost of manufacture and repair.

The face of the conventional exhaust valve is repeatedly inserted into the cylinder immediately after combustion when the cylinder contains the hot gaseous products of combustion. It thus becomes red hot and promotes preignition of the fuel charge. Preignition limits the compression ratio of the cylinder and its suppression may require increasing the octane rating of the fuel. The power output of an engine is directly related to the compression ratio of its cylinders.

In summary, the limitations of the conventional intake and exhaust valve used in internal combustion engines arise from its inherent sensitivity to fit when it is seated, as well as to the amount of time it is seated and, alternatively, open. As these parameters are directly affected by the mass and wear of the numerous moving parts in the linkage connecting the valve to the crankshaft, there is a limit to the valve's performance and reliability. The volumetric efficiency of an engine cylinder serviced by the valve is also limited. Further, the valve subjects the engine cylinder to preignition. Although there are modifications to the basic design which can improve various aspects of the valve's performance, any of these improvements come at the expense of reliability and other performance parameters.

There have been a number of rotary valve designs prompted by the aforementioned limitations inherent to the conventional valve. One approach is to situate one cylindrical sleeve concentrically within another. Both sleeves have ports and rotate relative to each other. Fluid communication with the engine cylinder is obtained when ports in both sleeves overlap or register with one another. Rotary valves of this type are shown in U.S. Pat. No. 1,299,264 issued to Thayer, U.S. Pat. No. 1,378,092 issued to Carmody, and U.S. Pat. No. 3,060,915 issued to Cole. Cole passes the fuel mixture axially through the hollow inner sleeve of an intake valve, and exhausts the products of combustion axially through the hollow inner sleeve of a parallel exhaust valve.

Another type of rotary valve uses a shaft having transverse passageways which alternatively communicate fuel and exhaust as it rotates. Examples of this type are shown in U.S. Pat. No. 3,990,427 issued to Cross et al, and U.S. Pat. No. 4,342,294 issued to Hopkins. Cross passes the fuel mixture and the exhaust gases through separate passageways running axially through the shaft.

SUMMARY OF THE INVENTION

The present invention is a rotary valve for an internal combustion engine. The valve is comprised of a cylinder having two parallel passageways running transversely through it. Each engine cylinder is serviced by one valve, although engine performance may be enhanced by servicing each engine cylinder with two rotary valves.

The top of the engine cylinder, also known as the combustion chamber, is formed by the valve together with the engine cylinder head. The valve rotates about an axis lying parallel to the engine crankshaft. The valve passageways cyclically communicate the engine cylinder with an intake port containing a mixture of air and fuel and, alternatively, an exhaust port.

More particularly, the revolution of the valve cylinder is coordinated with the reciprocating linear movement of the piston in the engine cylinder so that the rotary valve communicates the intake port with the engine cylinder during the piston's intake stroke. The rotary valve rotates to seal the cylinder while the fuel and air mixture is compressed by the piston and subsequently burned during the power stroke. Rotation of the rotary valve then communicates the cylinder with the exhaust port to exhaust the products of combustion during the piston's exhaust stroke.

The two passageways alternate being used. That is, one of the passageways is used for intake and then exhaust while the second passageway is not being used, and then the second passageway is used for the entire intake and exhaust cycle while the first passageway lies idle.

A throttle valve is located in the throat of the intake port in order to regulate the flow rate of the fuel and air mixture entering the cylinder, as well as to promote turbulence and mixing of the fuel, air and residual products of combustion. The latter function is particularly beneficial to engine efficiency and smooth operation at low rates of crankshaft revolution.

It is an object of the present invention to provide a valve for an internal combustion engine that increases the volumetric efficiency of the engine in comparison to the volumetric efficiency obtainable by the reciprocating valve of the prior art. Another object is to reduce parasitic power losses due to friction and pumping. A further object is to provide a valve that is quieter than the conventional reciprocating valve of the prior art.

Yet another object of the present invention is to eliminate the problems and inefficiencies occasioned by valve lag and valve float. An additional object is to provide a cooler exhaust valve to permit higher compression ratios without preignition. A further object is to increase turbulence and swirl in the cylinder to promote faster and more complete burning of the fuel. It is also an objective of the present invention to obtain the foregoing objectives without the mechanical complexity attendant to using concentric rotary sleeves.

DETAILED DESCRIPTION OF THE DRAWINGS

FIG. 4 is a fragmentary top plan view taken along line 4—4 of FIG. 3.

FIG. 5 is a sectional view taken along line 5—5 of FIG. 3.

FIGS. 6A through 6H comprise a sequential series of schematic drawings which show the rotational position of a rotary valve of the invention at various points in the operational cycle of a cylinder in a four cycle internal combustion engine.

Figure 7A:
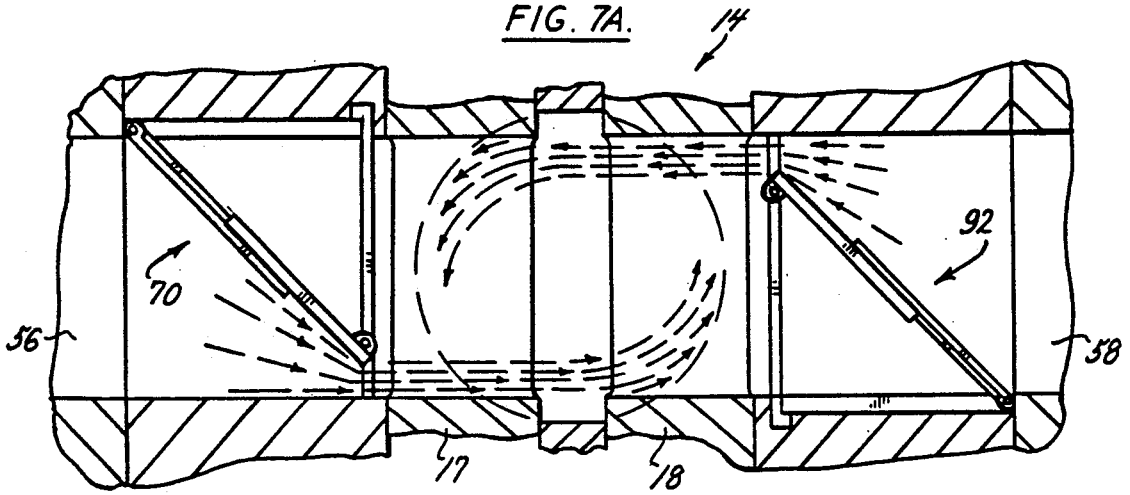
Figure 7B:
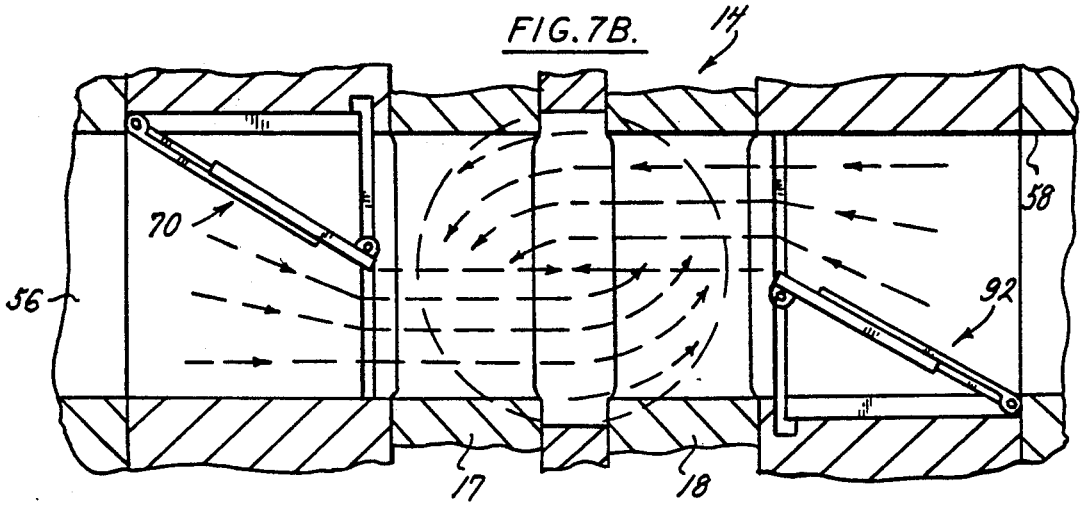
Figure 7C:
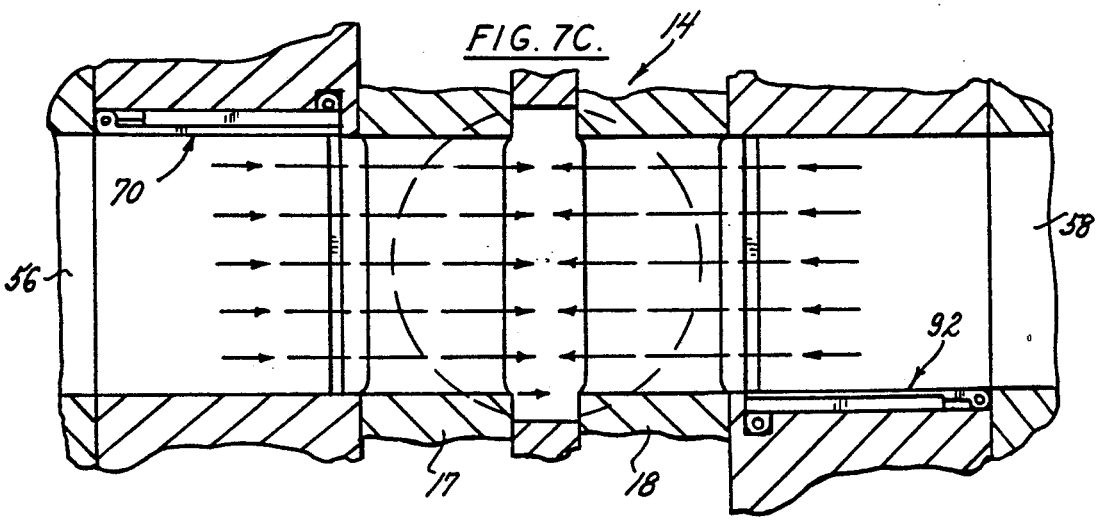

FIGS. 7A through 7C comprise three schematic drawings showing a throttle valve of the invention at three different throttle settings.

FIG. 8 is a perspective schematic drawing which shows a throttle valve and associated control linkages of the invention.

FIG. 9 is a fragmentary cross-sectional drawing of the engine showing a throttle valve of the invention.

FIG. 10 is a sectional view taken along line 10—10 of FIG. 9.

Figure 3:
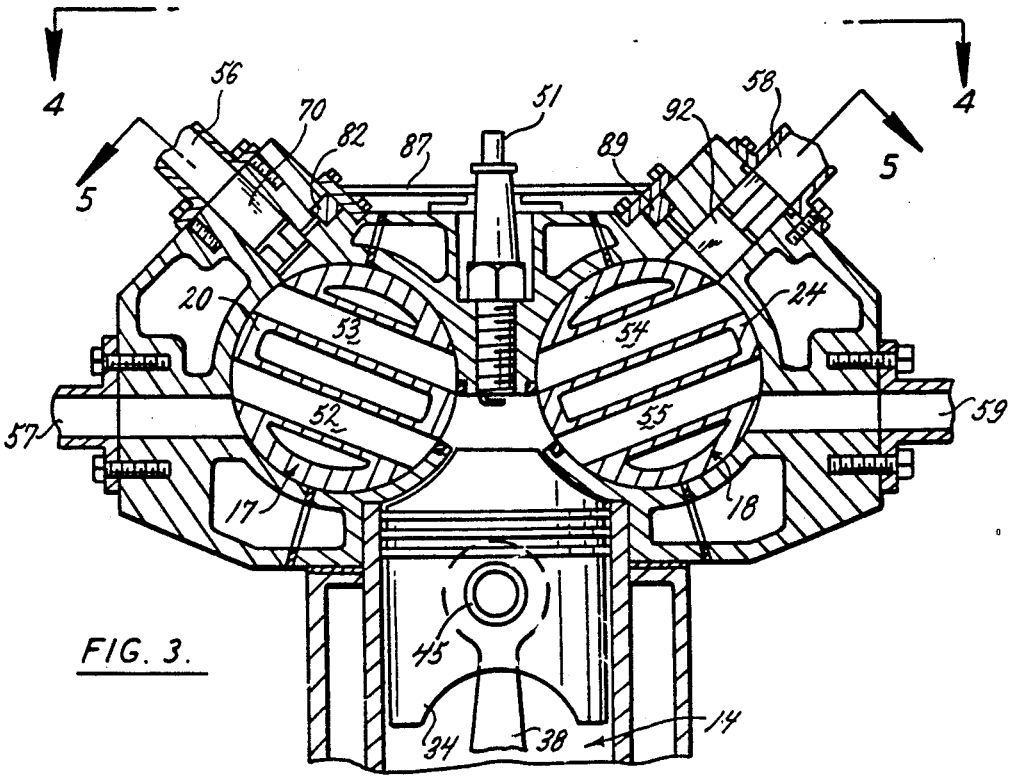
FIG. 3 is a sectional view taken along line 3—3 of FIG. 2.

FIG. 11 is the same sectional view as FIG. 3, but shows an embodiment of the invention slightly different than that shown in FIG. 3.

DETAILED DESCRIPTION OF PREFERRED EMBODIMENTS

Figure 1:
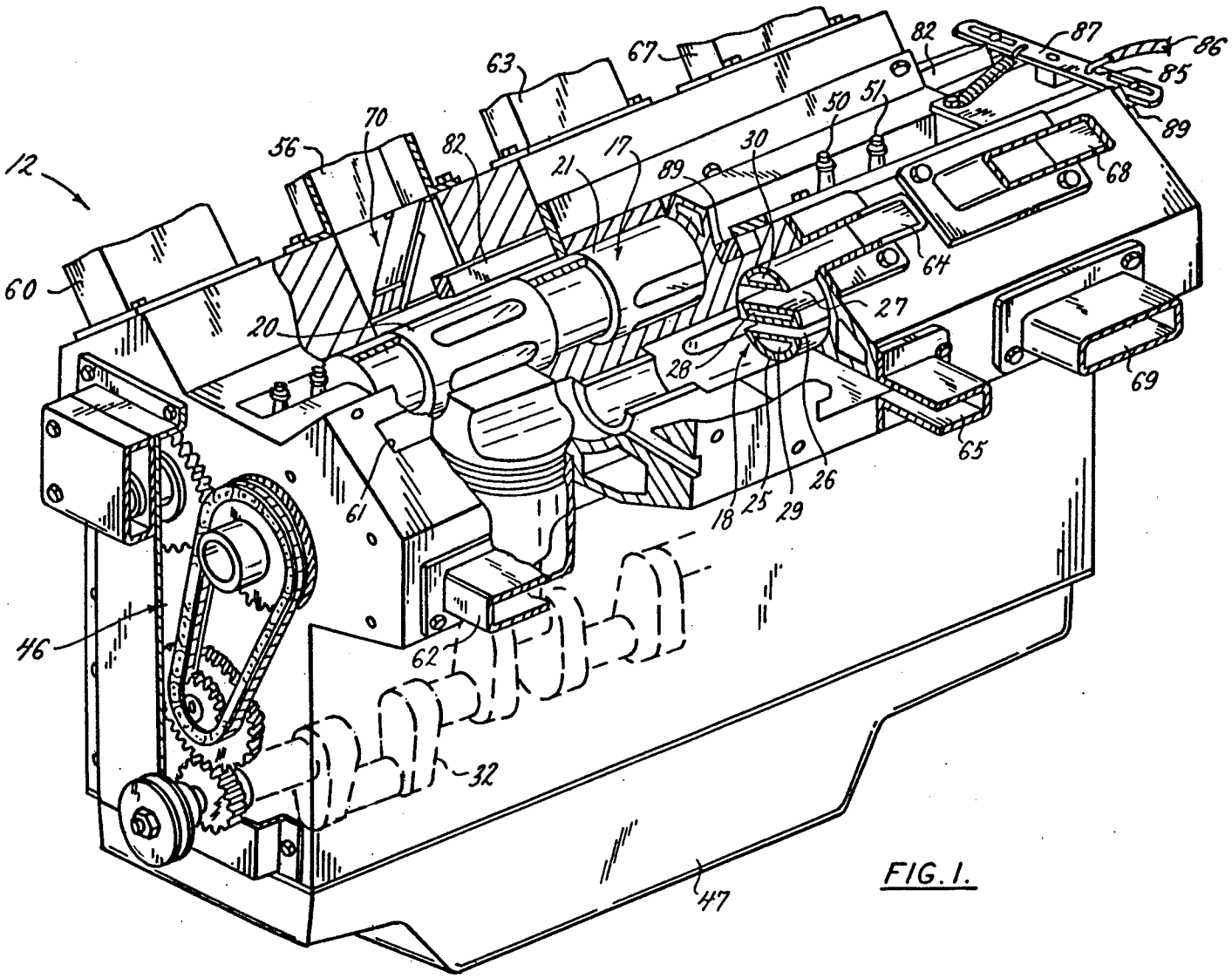
FIG. 1 is a perspective view of an engine equipped with the invention, with some parts broken away and shown in cross section.

Turning to the drawings, FIG. 1 provides a perspective view of engine 12, a reciprocating internal combustion engine. As best shown in the longitudinal cross-sectional view of engine 12 comprising FIG. 2, engine 12 has four in-line cylinders designated as cylinders 13, 14, 15 and 16. Engine 12 is equipped with parallel valve shafts 17 and 18. Part of valve shaft 17 and a cross-section of valve shaft 18 are shown in FIG. 1, whereas only valve shaft 17 is pictured in FIG. 2.

Figure 2:
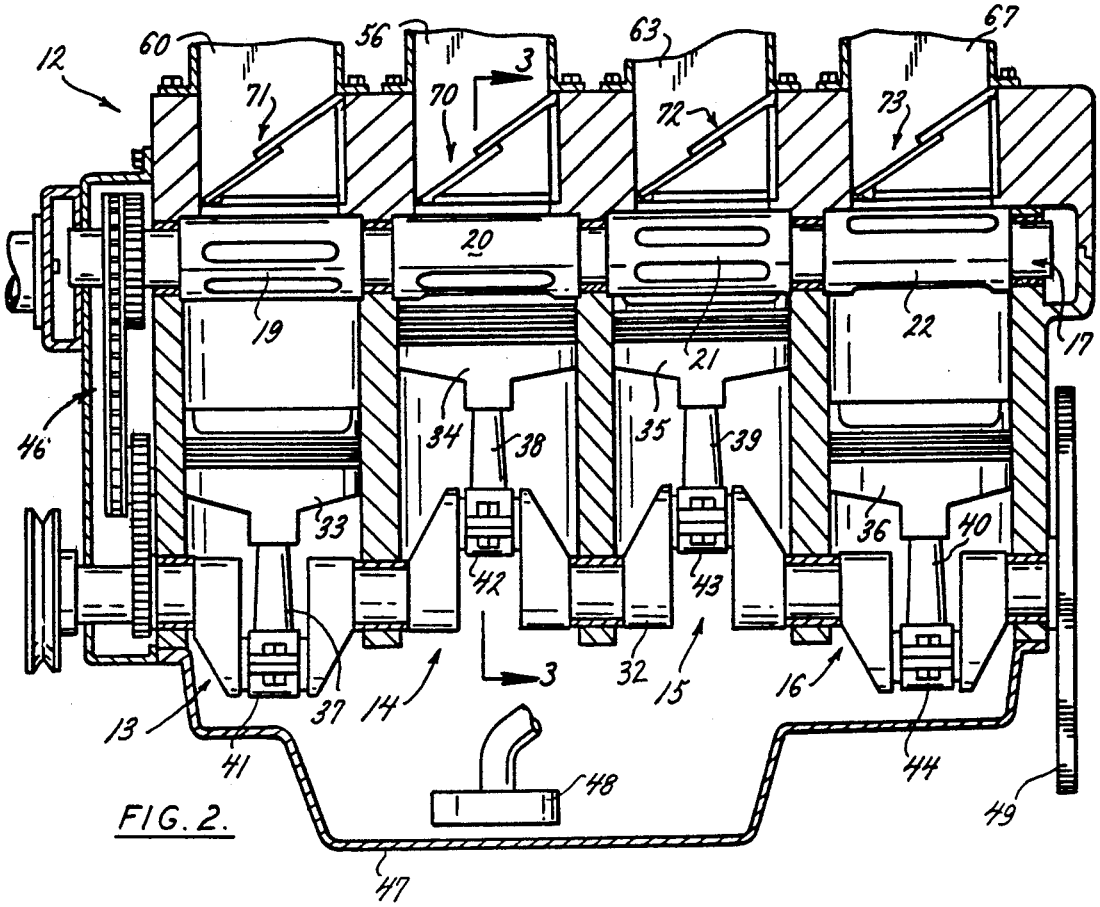
FIG. 2 is a partial longitudinal sectional view of the engine equipped with the invention. The timing chain assembly and flywheel are not sectioned.

Four rotary valves are integral to each valve shaft. More particularly, valve shaft 17 incorporates rotary valves 19, 20, 21 and 22, and valve shaft 18 incorporates rotary valves 24 and 25, with the remaining two rotary valves for valve shaft 18 not being shown. Rotary valve 20, part of rotary valve 21 and a cross-section of rotary valve 25 are shown in FIG. 1, whereas rotary valves 19, 20, 21 and 22 of valve shaft 17 are illustrated in FIG. 2.

Each of the rotary valves of the present invention has two parallel transverse passageways, with each passageway having a rectangular cross-section. For example, passageways 26 and 27 pass transversely through rotary valve 25. Each of the rotary valves also has three longitudinal cavities. For example, center cavity 28 and side cavities 29 and 30 are located within rotary valve 25. The aforementioned cavities are hollow. However, they may alternatively contain a material having a heat capacitance greater than that of the structural material with which the rotary valves are constructed in order to maximize the transfer of heat from the structural material and thereby keep it as cool as possible.

Another embodiment of the present invention would be to omit center cavity 28 and side cavities 29 and 30. The strength of the material with which the rotary valves are made in the temperature range to which the rotary valves would be subjected would dictate the embodiment of the present invention which would best suit a particular application.

Crankshaft 32 runs longitudinally through engine 12. As shown in FIG. 2, reciprocating pistons 33, 34, 35 and 36 aree respectively located in cylinders 13, 14, 15 and 16 of engine 12. Crankshaft 32 is rotatively connected to pistons 33, 34, 35 and 36 by means of rods 37, 38, 39 and 40, respectively; lower rod bearings 41, 42, 43 and 44, respectively; and wrist pins.

The connection of piston 34 to rod 38 by means of wrist pin 45 is shown in FIG. 3, which is a sectional view of the upper part of engine 12 taken through cylinder 14 along line 3—3 in FIG. 2. The remaining pistons are connected to their respective rods by wrist pins identical to wrist pin 45.

Timing chain assembly 46 rotatively connects an end of crankshaft 32 to valve shafts 17 and 18, and causes valve shafts 17 and 18 to rotate in opposite directions. Timing chain assembly 46 includes gear reduction means well known in the mechanical art, which reduces the revolution of valve shafts 17 and 18 to one-fourth of the revolution of crankshaft 32.

Motor oil reservoir 47 is situated at the bottom of engine 12 and oil pump pickup 48 is located therein. A motor oil pump (not shown) pumps the motor oil from motor oil reservoir 47 to lubricate and cool various moving parts of engine 12. Flywheel 49 is connected to the end of crankshaft 32 that is not connected to timing chain assembly 46.

Two spark plugs are threadably inserted into each of the engine cylinders in order to ignite a combustible fuel and air mixture. For example, spark plugs 50 and 51 are inserted into cylinder 14. Spark plugs 50 and 51 are shown in FIG. 4, a top plan view of cylinder 14 taken along line 4—4 of FIG. 3.

Each of the four cylinders of engine 12 is provided with a combustible mixture of fuel and air through its own set of two intake ports. Each of the two intake ports includes a fuel injector which injects fuel into a stream of air passing through the intake port. The mixture of fuel and air then passes through the valve of the present invention and into the cylinder. Each of the cylinders exhausts the products of combustion through its own set of two exhaust ports. The four pairs of exhaust ports communicate with an exhaust manifold and the four pairs of intake ports communicate with an intake manifold.

The communication provided by the rotary valve of the present invention between the intake and exhaust ports and the respective cylinders of engine 12 is most clearly shown by FIG. 3. Shown therein are transverse passageways 52 and 53 of rotary valve 20 and transverse passageways 54 and 55 of rotary valve 24. Passageways 52 and 53 of rotary valve 20 intermittently communicate intake port 56 and exhaust port 57 with cylinder 14. Passageways 54 and 55 of rotary valve 24 intermittently communicate cylinder 14 with intake port 58 and exhaust port 59.

Further, the transverse passageways through rotary valve 19 communicate cylinder 13 with intake port 60 and an exhaust port that is not shown. Cylinder 13 also communicates with intake port 61 and exhaust port 62 by means of a rotary valve (not shown) which is part of valve shaft 18.

Intake port 63 and an exhaust port that is not shown communicate with cylinder 15 by means of rotary valve 21. Cylinder 15 also communicates with intake port 64 and exhaust port 65 by means of transverse passageways 26 and 27 in rotary valve 25.

Rotary valve 22 communicates cylinder 16 with intake port 67 and an exhaust port that is not shown. Cylinder 16 also communicates with intake port 68 and exhaust port 69 by means of a rotary valve (not shown) which is part of valve shaft 18.

The fuel injectors for the cylinders are not shown because they are located upstream of the section of the intake ports which is shown in the drawings.

The manner in which the rotary valve of the present invention functions is best explained with reference to FIGS. 6A through 6H, a sequential series of schematic drawings showing the rotational position of rotary valves 20 and 24 in relation to the position of piston 34 at various points in the operational cycle of cylinder 14. For the sake of clarity, spark plugs 50 and 51 for cylinder 14 and the center and side cavities of rotary valves 20 and 24 have been omitted.

Figure 6A:
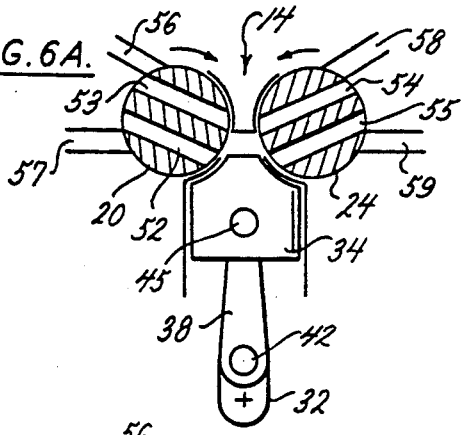

FIG. 6A shows the position of rotary valves 20 and 24 and piston 34 as piston 34 has reached top dead center at the completion of its exhaust stroke. Passageways 52 and 53 of rotary valve 20 and passageways 54 and 55 of rotary valve 24 are not communicating with cylinder 14, and thus cylinder 14 is sealed.

Figure 6B:
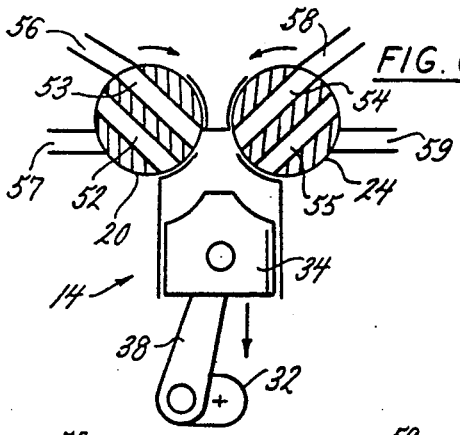

FIG. 6B shows piston 34 moving downward in the middle of its intake stroke. Rotary valves 20 and 24 have rotated clockwise and counterclockwise, respectively, so that intake ports 56 and 58 now communicate through valve passageways 53 and 54, respectively, with cylinder 14, and a fuel and air mixture flows into cylinder 14.

Figure 6C:
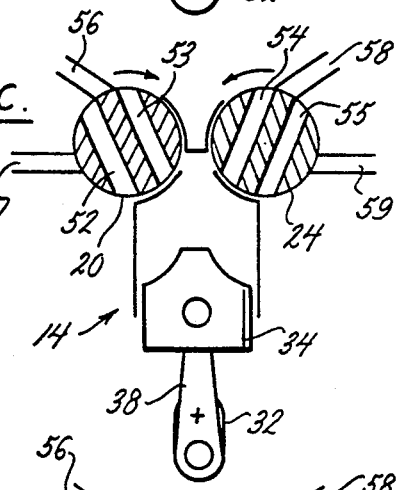

FIG. 6C shows piston 34 at bottom dead center at the completion of its intake stroke. Rotary valves 20 and 24 have continued rotating clockwise and counterclockwise, respectively, so that valve passageways 53 and 54 no longer provide communication between intake ports 56 and 58, respectively, and cylinder 14. As the passageways are not providing communication with exhaust ports 57 and 59, cylinder 14 is sealed.

Figure 6D:
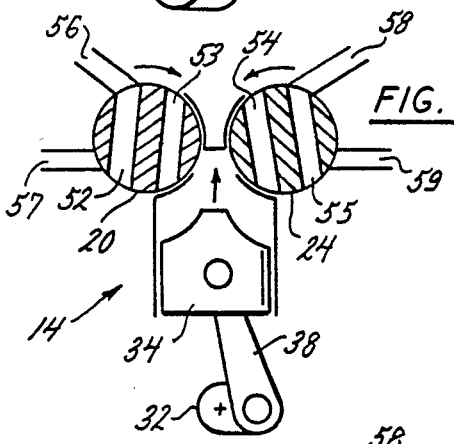

FIG. 6D shows piston 34 in the middle of its compression stroke, where it is compressing the fuel and air mixture contained in cylinder 14 prior to combustion. Rotary valves 20 and 24 have continued rotating, but the passageways through the valves are situated so that cylinder 14 does not communicate with intake ports 56 and 58 or exhaust ports 57 and 59. Cylinder 14 is thus sealed.

Figure 6E:
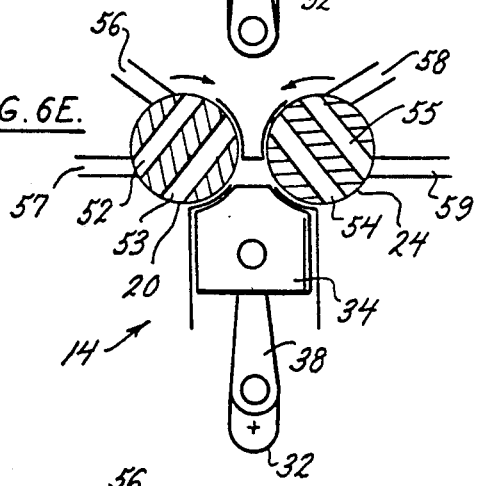
Figure 6F:
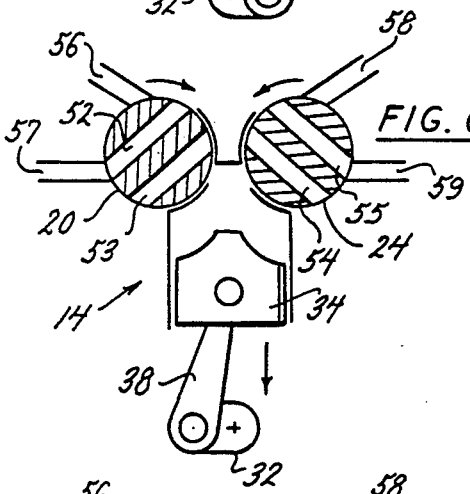
Figure 6G:
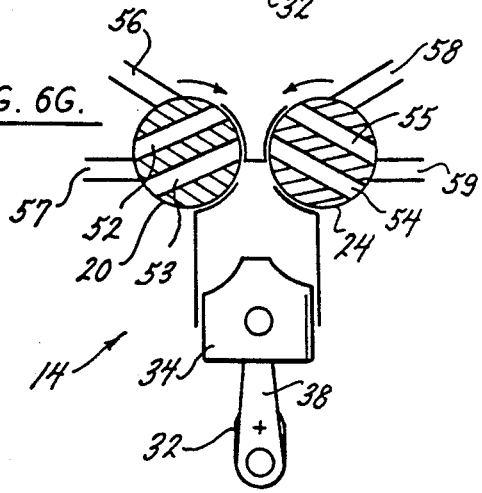

FIG. 6E shows piston 34 at top dead center. Spark plugs 50 and 51 for cylinder 14 have initiated combustion of the fuel and air mixture just before this point. This figure shows the beginning of the power stroke of piston 34. FIG. 6F shows piston 34 halfway through its power stroke downward. FIG. 6G shows piston 34 at bottom dead center at the conclusion of its power stroke. It is poised to begin its exhaust stroke. Rotary valves 20 and 24 continue to rotate in their respective directions for all three of the foregoing drawings, but cylinder 14 remains sealed.

As piston 34 begins its exhaust stroke by moving upwards, rotary valves 20 and 24 continue to rotate clockwise and counterclockwise, respectively, so that passageways 53 and 54 allow cylinder 14 to begin communicating with exhaust ports 57 and 59, respectively. This allows the products of combustion to be expelled from cylinder 14 and into exhaust ports 57 and 59.

Figure 6H:
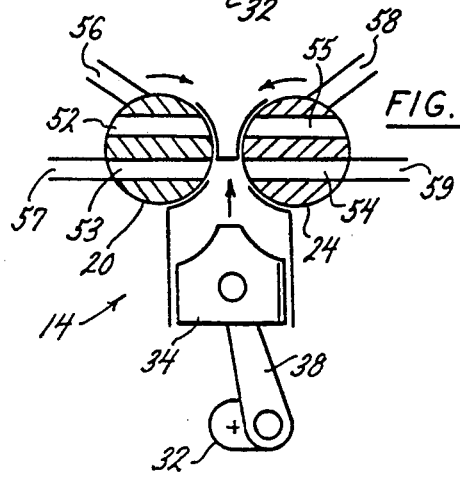

FIG. 6H shows piston 34 halfway through its exhaust stroke. At this point, passageways 53 and 54 are in perfect alignment with exhaust ports 57 and 59, respectively. Rotary valves 20 and 24 continue to rotate so that communication between exhaust ports 57 and 59 and cylinder 14 will no longer occur when piston 34 reaches top dead center to end its exhaust stroke.

At top dead center, the position of rotary valves 20 and 24 and piston 34 will appear as shown in FIG. 6A, but with passageways 52 and 55 located adjacent to intake ports 56 and 58, respectively. The positioning of rotary valves 20 and 24 for the next combustion cycle of cylinder 14 will be the same as described above in conjunction with FIGS. 6A through 6H, but with communication between cylinder 14 and the ports being provided by passageways 52 and 55, with passageways 53 and 54 being idle. Communication through the parallel passageways of each rotary valve will thus alternate between them, with one passageway being used exclusively on every other combustion cycle of its adjacent cylinder.

As shown in FIGS. 6A through 6H, rotary valves 20 and 24 rotate clockwise and counterclockwise, respectively. Intake ports 56 and 58 are located above their respective rotary valves, and exhaust ports 57 and 59 are located on opposite sides of engine 12.

In an alternative embodiment of the invention, the rotary valves of the invention rotate in the opposite directions as those shown. In such an alternative embodiment, rotary valves 20 and 24 rotate counterclockwise and clockwise, respectively, the intake ports are located on the sides of the engine, and the exhaust ports are located on the top. The function and operative sequence of the valves is otherwise identical to those detailed herein. However, the foregoing alternative embodiment would allow the exhaust to vent from the top of the engine rather than from the sides, which could be desirable in particular applications.

The invention is shown as having two parallel valve shafts and two rotary valves for each cylinder. An engine could also be equipped with just one valve shaft. In this variation, each cylinder would be serviced by only one rotary valve. The single valve shaft and set of rotary valves could be either of the two described in detail herein. Each of the single set of valves would function in conjunction with its adjacent piston as shown for either rotary valve 20 or 24 in FIGS. 6A through 6H. For the same engine, using one valve shaft as opposed to two would lower its volumetric efficiency and thus its performance, especially at higher rates of crankshaft revolution.

Located in each intake port is a throttle valve whose function is to regulate the flow of the fuel and air mixture into the cylinder. As will be explained by the discussion that follows, the throttle valve of the invention should also enhance the mixing of the fuel and air to improve atomization and vaporization of the fuel and ultimately promote rapid and even combustion throughout the cylinder. Further, the throttle valve is designed to perform the foregoing functions over the entire range of engine operating speeds, that is, from idle to the maximum rate of revolution of the crankshaft.

The location of the throttle valve in each of the intake ports is the same as the location of throttle valve 70 in intake port 56 illustrated by a partial cutaway of intake port 56 in FIG. 1. As further shown in FIG. 2, throttle valves 71, 72 and 73 are located in intake ports 60, 63 and 67, respectively.

An enlarged side view of throttle valve 70 located in intake port 56 is shown in FIG. 9. A front view of throttle valve 70 taken along line 10—10 of FIG. 9 is shown in FIG. 10. Throttle valve 70 is composed of panels 74 and 75. The panels are slideably attached to each other by means of a tongue-and-groove system. More particularly, tongue 76 extends from panel 75 and is slideably engaged with groove 77 in the opposing surface of panel 74. The opposing edges of tongue 76 and groove 77 are beveled so that tongue 76 is confined to traveling within groove 77.

While one end of panel 74 is slideably engaged with panel 75, pivot rod 78 passes through a lateral passageway in the other end of panel 74. Panel 74 is free to rotate about pivot rod 78. The ends of pivot rod 78 extend beyond the width of panel 74 and are attached to the opposing walls of intake port 56.

One end of panel 75 is slideably engaged with panel 74, while pivot rod 79 passes through a lateral passageway in the other end of panel 75. Panel 75 is free to rotate about pivot rod 79. The ends of pivot rod 79 extend beyond the width of panel 74. One end of pivot rod 79 projects into guide slot 80 located in a wall of intake port 56, while its other end passes through slot 81 in the opposing wall of intake port 56 and is attached to lever 82.

Since panels 74 and 75 are slideably attached to each other and since the ends of the panels that are not slideably attached are free to rotate, the translation of lever 82 causes the translation of panel 74 relative to panel 75. Referring to FIG. 9, the movement of lever 82 and with it pivot rod 79 to the right would cause panel 75 to slide beneath panel 74 and result in the opening of throttle valve 70. All of the throttle valves are identically constructed and their movements are coordinated by means of throttle linkage 83 as shown in the schematic drawing comprising FIG. 8.

Throttle linkage 83 is comprised of throttle pedal 84, cable 85, cable sheath 86, pivot bar 87, return spring 88 and levers 82 and 89. Throttle pedal 84 is connected to one end of cable 85. The other end of cable 85 is attached to pivot bar 87.

Cable 85 slides within cable sheath 86. Cable sheath 86 is anchored so that it does not move with cable 85. One end of return spring 88 is anchored and its other end is attached to pivot bar 87. Return spring 88 and cable 85 are attached to pivot bar 87 on opposite sides of the pivot point about which pivot bar 87 rotates.

Pivot bar 87 has a slot located near each of its ends. Contained in one slot is a peg projecting from one end of lever 82 and contained in the other slot is a peg projecting from an end of lever 89. The pegs are free to travel within their respective slots.

Throttle valve 91 is located in intake port 61 for cylinder 13, throttle valve 92 is located in intake port 58 for cylinder 14, throttle valve 93 is located in intake port 64 for cylinder 15, and throttle valve 94 is located in intake port 68 for cylinder 16. Throttle valves 91, 92, 93, and 94 are attached to lever 89 and throttle valves 71, 72 and 73 are attached to lever 82 by pivot rods in the manner shown for the attachment of throttle valve 70 to lever 82 by pivot rod 79.

All of the throttle valves operate in the manner as previously described with respect to throttle valve 70. However, throttle valves 70 to 73 retract to open in the rearward direction, while opposing throttle valves 91 to 94 retract to open in the forward direction. The rearward translation of lever 82 thus causes connected throttle valves 70 to 73 to open, while the forward movement of lever 89 causes connected throttle valves 91 to 94 to open. The significance and advantage of this arrangement will be subsequently discussed.

Depression of throttle pedal 84 by the operator causes cable 85 to exert a force against pivot bar 87 which creates a clockwise moment acting on pivot bar 87 about its pivot point. Where this moment exceeds the opposing moment caused by the restraining force exerted on pivot bar 87 by return spring 88, pivot bar 87 rotates in a clockwise direction. This rotation of pivot bar 87 forces lever 82 to move rearward and lever 89 to simultaneously move forward. As previously explained, the rearward translation of lever 82 and the forward translation of lever 89 results in the concurrent opening of all eight throttle valves. The opening of the throttle valves increases the rate of flow of the fuel and air mixture into the cylinders of engine 12, and results in an increase in the rate of revolution of crankshaft 32.

When the moment generated by return spring 88 on pivot bar 87 exceeds the opposing moment resulting from force being applied by throttle pedal 84 by means of cable 85, pivot bar 87 rotates in a counterclockwise direction. This causes lever 82 to move forward and lever 89 to move rearward which, in turn, causes the throttle valves to close and decreases the rate of revolution of crankshaft 32.

FIGS. 7A, 7B and 7C are schematic drawings showing throttle valves 70 and 92 respectively located in intake ports 56 and 58. A stream of liquid fuel is injected into each of intake ports 56 and 58 by respective fuel injectors (not shown) located upstream of throttle valves 70 and 92. The two foregoing intake ports supply the fuel and air mixture for cylinder 14.

FIG. 7A shows throttle valves 70 and 92 in an almost closed position, in which they are allowing the passage of only the minimum amount of fuel and air mixture necessary to allow engine 12 to idle smoothly. The lower static pressure in cylinder 14 relative to the static pressure in intake ports 56 and 58 should accelerate the fuel and air mixture to sonic velocity at the throats respectively created by throttle valves 70 and 92. This acceleration will cause breakup and atomization of the fuel droplets and thus enhance the vaporization of the fuel, as well as causing turbulence in cylinder 14 and promoting mixing of the entering fuel and air mixture with gases produced by combustion and remaining in cylinder 14 from the prior combustion cycle.

Throttle valves 70 and 92 open in opposite directions so that the fluid enters cylinder 14 from two different sides. This creates high speed swirling and promotes mixing of the fuel, air and residual products of combustion, as well as aiding the dissemination of the mixture throughout the volume of the cylinder during the short interval of the intake and compression strokes.

The velocity of the airstream in an intake port is relatively low when the engine is idling, in comparison to when the engine is operating at a greater rate of crankshaft revolution. This would normally result in relatively poor mixing and could cause the engine to idle roughly unless the idle setting of the throttle is set high enough. Having throttle valves 70 and 92 open in opposite directions should enhance the turbulence and mixing at idle so that the throttle setting at idle can be lower than would otherwise be the case. This should lower the fuel consumption of the engine.

FIG. 7B shows the position of throttle valves 70 and 92 when throttle pedal 84 is depressed to half of its maximum travel. The swirling effect of having throttle valves 70 and 92 open from opposite directions should still be evident. The enhanced turbulence and mixing should result in more complete combustion of the fuel and air mixture, which would translate into improved engine efficiency and performance at engine speeds above idle, such as at cruising speed.

FIG. 7C shows throttle valves 70 and 92 fully retracted along the walls of intake ports 56 and 58, respectively, which is the position they will be in when throttle pedal 84 is fully depressed and engine 12 is operating at maximum power. There will be no swirling induced by having the opposing throttle valves open in opposite directions for the full throttle position. However, the velocity of the airstream in an intake port is at its maximum for this operating condition, and thus no enhancement of turbulence and mixing should be necessary.

FIG. 11 shows another embodiment of the invention which differs slightly from the preferred embodiment discussed in detail herein, and which is intended to increase the power of engine 12 over that which can be obtained using the aforementioned preferred embodiment. The drawing is a cross-sectional view of cylinder 14. Piston 34 is at top dead center at the beginning of its intake stroke. For purposes of comparison, this is the same view of the preferred embodiment provided by FIG. 3.

The difference between this variation and the preferred embodiment is that the height of transverse passageways 52 and 53 of rotary valve 20 and transverse passageways 54 and 55 of rotary valve 24 is increased over the passageway height shown in FIG. 3. The height of the transverse passageways in the other rotary valves is likewise increased. This modification allows the the intake of the fuel and air mixture into cylinder 14 to begin earlier than would be the case for the smaller passageway height of the preferred embodiment. The foregoing modification should improve the volumetric efficiency of engine 12 by increasing the amount of combustible mixture in the cylinder when the spark ignites combustion, and thereby increase the power output of the engine without changing its displacement. The improvement should be most noticeable at high rates of crankshaft revolution.

However, as shown in the drawing, the early intake of the fuel and air mixture is accompanied by an overlap with the communication of cylinder 14 with exhaust ports 57 and 59 through transverse passageways 52 and 55, respectively, which are at the end of their exhaust cycle. Thus, some of the fuel and air mixture could be exhausted through transverse passageways 52 and 55 at the end of the exhaust stroke and the beginning of the intake stroke. If the overlap is too great, fuel economy will suffer and the engine will not operate smoothly at low rates of crankshaft revolution.

Another modification is to have a fuel injector located on only one of the two intake ports communicating with each engine cylinder. The intake port without the fuel injector would inject only air into the cylinder when cyclically communicating with the cylinder. This variant would simplify manufacture and reduce costs for lower performance vehicles.

Changes and modifications in the specifically described embodiments can be carried out without departing from the scope of the invention, which is intended to be limited only by the scope of the appended claims.

What is claimed is:

1. A rotary valve for an internal combustion engine comprising:

a valve cylinder having two parallel and transverse passageways bored therethrough:

a valve shaft including a plurality of said valve cylinders, and being capable of rotating about an axial axis of rotation:

said engine including a plurality of engine cylinders, intake ports, and exhaust ports:

two of said valve shafts lying in parallel, namely, a first valve shaft and a second valve shaft;

each of said engine cylinders fluidly communicating with one of said exhaust ports and one of said intake ports by means of one of said valve cylinders included in said first valve shaft, and also fluidly communicating with another of said exhaust ports and another of said intake ports by means of one of said valve cylinders included in said second valve shaft; and said two valve shafts rotating in opposite directions.

2. A rotary valve for an internal combustion engine comprising:

a valve cylinder having two parallel and transverse passageways bored therethrough;

two of said valve cylinders being respectively rotatable about two axial axes of rotation;

said axes of rotation being comprised of a first axis and a second axis, with said axes lying in parallel;

said valve cylinders being comprised of a first valve cylinder rotatable about said first axis, and a second valve cylinder rotatable about said second axis;

said engine including an engine cylinder, a first intake port and a second intake port;

said first intake port fluidly communicating with said engine cylinder by means of said first valve cylinder;

said second intake port fluidly communicating with said engine cylinder by means of said second valve cylinder;

a throttle valve being located in each of said intake ports;

said throttle valve being extendible across said intake port in which it is located; and said throttle valves extending to close their respective intake ports in opposite directions; whereby mixing in said engine cylinder is enhanced.

3. The apparatus recited in claim 2 further comprising:

two exhaust ports, namely, a first exhaust port and a second exhaust port;

said two passageways being a first passageway and a second passageway;

fluid communication between said engine cylinder and said first intake port and fluid communication between said engine cylinder and said first exhaust port both being provided during half revolutions of said first valve cylinder about said first axis, by said first passageway of said first valve cylinder during a first half revolution and by said second passageway of said first valve cylinder during a second half revolution; and fluid communication between said engine cylinder and said second intake port and fluid communication between said engine cylinder and said second exhaust port both being provided during half revolutions of said second valve cylinder about said second axis, by said first passageway of said second valve cylinder during a first half revolution and by said second passageway of said second valve cylinder during a second half revolution.

4. The apparatus recited in claim 3 wherein:

fluid communication between said first intake port and said engine cylinder is cut off by said first valve cylinder during fluid communication between said first exhaust port and said engine cylinder; and fluid communication between said second intake port and said engine cylinder is cut off by said second valve cylinder during fluid communication between said second exhaust port and said engine cylinder.

5. The apparatus recited in claim 4 wherein:

fluid communication between said first exhaust port and said engine cylinder is cut off by said first valve cylinder during fluid communication between said first intake port and said engine cylinder; and fluid communication between said second exhaust port and said engine cylinder is cut off by said second valve cylinder during fluid communication between said second intake port and said engine cylinder.

6. The apparatus recited in claim 3 wherein:

said first valve cylinder provides fluid communication between said first intake port and said engine cylinder and, simultaneously, between said first exhaust port and said engine cylinder during a minor portion of each half revolution of said first valve cylinder about said first axis; and said second valve cylinder provides fluid communication between said second intake port and said engine cylinder and, simultaneously, between said second exhaust port and said engine cylinder during a minor portion of each half revolution of said second valve cylinder about said second axis.

7. A rotary valve for an internal combustion engine comprising:

a valve cylinder having two parallel and transverse passageways bored therethrough;

said valve cylinder being capable of rotating about an axial axis of rotation;

an intake port, an exhaust port and an engine cylinder being included in said engine;

said valve cylinder providing for intermittent fluid communication between said intake port and said engine cylinder, and providing for intermittent fluid communication between said exhaust port and said engine cylinder, by rotating about said axis of rotation;

a throttle valve comprised of two panels overlapping and slideably attached to each other; and said throttle valve being located in said intake port and being extendible across said intake port; whereby fluid flow through said intake port is regulated.

8. The apparatus recited in claim 7 wherein:

said two panels are comprised of a first panel and a second panel;

said first panel is rotatably attached to a wall of said intake port;

said second panel is rotatably attached to a pivot rod; and said pivot rod is attached to a lever that is free to translate relative to said intake port; whereby extension of said throttle valve across said intake port is controlled by translation of said lever relative to said intake port.

9. The apparatus recited in claim 8 further comprising:

a plurality of said valve cylinders;

said engine having a plurality of said engine cylinders and said intake ports;

each of said engine cylinders fluidly communicating with one of said intake ports by means of one of said valve cylinders, respectively;

each of said pivot rods being connected to said lever;

a throttle pedal; and linkage means for connecting said throttle pedal to said lever so that movement of said throttle pedal causes translation of said lever relative to said intake ports; whereby movement of said throttle pedal controls extension of said throttle valves across said intake ports.

10. The apparatus recited in claim 8 further comprising:

a plurality of said valve cylinders;

said engine having a plurality of said engine cylinders and said intake ports;

said intake ports including first intake ports and second intake ports;

each of said engine cylinders fluidly communicating by means of two of said valve cylinders, respectively, with one of said first intake ports and one of said second intake ports;

a plurality of said throttle valves, including first throttle valves and second throttle valves;

each of said first intake ports containing one of said first throttle valves and each of said second intake ports containing one of said second throttle valves;

two of said levers, namely, a first lever and a second lever;

said first lever being connected to said first throttle valves and said second lever being connected to said second throttle valves;

a throttle pedal; and a linkage means for connecting said throttle pedal to said first and second levers so that movement of said throttle pedal causes said first and second throttle valves to extend and thereby close said first and second intake ports, respectively, in opposite directions; whereby mixing in said engine cylinders is enhanced.

11. In an engine of the type having an engine cylinder and an intake port, the improvement comprising:

valve means for providing intermittent fluid communication between the intake port and the engine cylinder;

a throttle valve located in the intake port, comprised of a first panel and a second panel that overlap and are slideably attached to each other;

said first panel being rotatably attached to a wall of the intake port;

said second panel being rotatably attached to a pivot rod; and said pivot rod being attached to a lever that is free to translate relative to the intake port; whereby said panels can be extended across the intake valve by the translation of said lever to control fluid flow through the intake port.

12. The apparatus recited in claim 11 further comprising:

the engine having a plurality of the engine cylinders and the intake ports;

the intake ports including first intake ports and second intake ports;

each of the engine cylinders fluidly communicating with one of the first intake ports and one of the second intake ports;

a plurality of said throttle valves including first throttle valves and second throttle valves;

each of the first intake ports containing one of said first throttle valves and each of the second intake ports containing one of said second throttle valves;

two of said levers, namely, a first lever and a second lever;

said first lever being connected to said first throttle valves and said second lever being connected to said second throttle valves;

a throttle pedal; and a linkage means for connecting said throttle pedal to said first and second levers so that movement of said throttle pedal causes said first and second throttle valves to extend and thereby close the first and second intake ports, respectively, in opposite directions; whereby mixing in the engine cylinders is enhanced.

13. A rotary valve for an internal combustion engine comprising:

a valve cylinder being capable of rotating about an axial axis of rotation;

said valve cylinder having two transverse passageways bored therethrough, with said passageways lying parallel when viewed along said axial axis of rotation;

an intake port, an exhaust port and an engine cylinder being included in said engine;

said valve cylinder providing for intermittent fluid communication between said intake port and said engine cylinder, and providing for intermittent fluid communication between said exhaust port and said engine cylinder, by rotating about said axis of rotation; and the fluid communication between said intake port and said engine cylinder occurring simultaneously with the fluid communication between said exhaust port and said engine cylinder during a minor portion of each half revolution of said valve cylinder.

14. The rotary valve recited in claim 13 wherein:

said two passageways are comprised of a first passageway and a second passageway; and fluid communication between said engine cylinder and said intake port and fluid communication between said engine cylinder and said exhaust port both are provided during a first half revolution of said valve cylinder primarily by said first passageway and during a second half revolution of said valve cylinder primarily by said second passageway.

15. A rotary valve for an internal combustion engine comprising:

a valve cylinder being capable of rotating about an axial axis of rotation;

said valve cylinder having two parallel and transverse passageways bored therethrough, with said passageways being a first passageway and a second passageway;

an intake port, an exhaust port and an engine cylinder being included in said engine;

fluid communication between said engine cylinder and said intake port and fluid communication between said engine cylinder and said exhaust port both being primarily provided by said first passageway during a first half revolution of said valve cylinder and by said second passageway during a second half revolution of said valve cylinder; and fluid communication between said intake port and said engine cylinder occurring simultaneously with fluid communication between said exhaust port and said engine cylinder during a minor portion of each half revolution of said valve cylinder.

* * * * *